US005560052A

United States Patent [19]

Ferguson et al.

[11] Patent Number: 5,560,052

[45] Date of Patent: Oct. 1, 1996

[54] GARBAGE DISPOSAL ASSEMBLY WITH DECORATIVE SINK FLANGE MASK

[75] Inventors: Lloyd G. Ferguson, Marietta, Ga.; Peter J. Taylor, Bishops Woods, United Kingdom

[73] Assignee: Delta Engineering Holding Limited, Kingsway, England

[21] Appl. No.: 475,792

[22] Filed: Jun. 7, 1995

Related U.S. Application Data

[63] Continuation of Ser. No. 188,216, Jan. 27, 1994, abandoned, which is a continuation of Ser. No. 817,779, Jan. 8, 1992, Pat. No. 5,318,230.

[51] Int. Cl.[6] ..... E03C 1/182

[52] U.S. Cl. ..... 4/650; 4/654; 4/287; 4/DIG.4

[58] Field of Search ..... 4/286, 287, 295, 4/629, 650, 654, DIG. 4; 241/46.013, 46.016; 285/46

[56] References Cited

U.S. PATENT DOCUMENTS

| | | | |
|---|---|---|---|
| 2,323,224 | 6/1943 | Kuhnle | 4/286 |
| 2,782,057 | 2/1957 | Moore, Jr. | 4/DIG. 4 |
| 2,793,373 | 5/1957 | Ewing | 4/295 X |
| 3,411,628 | 11/1968 | Mason | 4/286 |
| 3,693,892 | 9/1972 | Musa | 241/46.016 |
| 3,880,363 | 4/1975 | Guth et al. | 241/100.5 |
| 3,982,703 | 9/1976 | Meyers | 241/100.5 |
| 4,310,933 | 1/1982 | Stratman | 4/DIG. 4 |
| 4,752,035 | 6/1988 | Felder | 241/46.016 |
| 5,318,230 | 6/1994 | Ferguson et al. | 241/46.013 |

FOREIGN PATENT DOCUMENTS

| | | | |
|---|---|---|---|
| 0614553 | 2/1961 | Canada | 4/295 |
| 0981507 | 1/1965 | United Kingdom | 4/287 |

OTHER PUBLICATIONS

In–Sink Erator Marketing Information For A Disposal Assembly–1989.

*Primary Examiner*—Robert M. Fetsuga
*Attorney, Agent, or Firm*—Louis T. Isaf, P.C.

[57] ABSTRACT

An improved garbage disposal assembly with an apparatus and related method for selectively varying the sink-side appearance of the garbage disposal assembly. In its preferred embodiment, the apparatus of the present invention includes a decorative flange mask for covering a sink flange of a garbage disposal. A sink flange includes an open cylindrical body portion for insertion through a drainage hole of a sink bottom and an annular lip portion extending radially outward from one end of the cylindrical body portion for location above the sink bottom. The decorative flange mask, in accordance with the preferred embodiment of the present invention, includes an open cylindrical mask body for insertion into the cylindrical body portion of the sink flange and an annular mask lip connected to and extending radially outward from one end of the cylindrical mask body for covering the annular lip portion of the sink flange.

48 Claims, 3 Drawing Sheets

GARBAGE DISPOSAL ASSEMBLY WITH DECORATIVE SINK FLANGE MASK

This is a continuation of application Ser. No. 08/188,216, filed Jan. 27, 1994, abandoned which is a continuation of application Ser. No. 07/817,779, filed Jan. 8, 1992, U.S. Pat. No. 5,318,230, issued Jun. 7. 1994.

BACKGROUND OF THE INVENTION

The present invention relates generally to the field of garbage disposals, and, in its most preferred embodiments, to the field of garbage disposal sink attachments.

Ordinary stainless steel sinks have existed for many years. More recently, sinks have become available in a variety of colors to match various kitchen interior designs. While colored sinks often enhance the appearance of a kitchen, an ordinary stainless steel sink flange of a garbage disposal frequently sticks out like a sore thumb when installed in a colored sink. The typical garbage disposal is supplied with an ordinary stainless steel sink flange. When installed, the ordinary stainless steel sink flange does not match the colored sink and, therefore, detracts from the overall appearance of the sink.

One method of achieving continuity in color between the sink and the disposal sink flange is to replace the ordinary stainless steel disposal sink flange with an appropriately colored replacement sink flange. There are, however, many problems related to this course of action. Many garbage disposal assemblies are relatively difficult to disassemble and reassemble with new sink flanges. Furthermore, many consumers are unable, or unwilling, to engage in a task which is usually quite unpleasant and requires an extensive amount of time. Therefore, the various problems relating to disassembling and reassembling garbage disposals render this option impractical for many people in many environments.

There is, therefore, a need in the industry for an apparatus which solves these and other related, an unrelated, problems.

SUMMARY OF THE INVENTION

Briefly described, the present invention comprises a garbage disposal assembly with an apparatus and related method for selectively varying the sink-side appearance of the garbage disposal assembly. In its preferred embodiment, the apparatus of the present invention includes a decorative flange mask for covering a sink flange of a garbage disposal. A sink flange includes an open cylindrical body portion for insertion through a drainage hole of a sink bottom and an annular lip portion extending radially outward from one end of the cylindrical body portion for location above the sink bottom.

The decorative flange mask, in accordance with the preferred embodiment of the present invention, includes an open cylindrical mask body for insertion into the cylindrical body portion of the sink flange and an annular mask lip connected to and extending radially outward from one end of the cylindrical mask body for covering the annular lip portion of the sink flange.

Rather than requiring any disassembly of a previously installed garbage disposal, the installation of the preferred embodiment of the present invention involves the quick and easy steps of applying a sealant around the flange mask and pushing the flange mask straight down into the open cylindrical body portion of the sink flange of the garbage disposal. After these convenient steps, the ordinary stainless steel sink flange of the garbage disposal is, for the most part, hidden from view.

It is therefore an object of the present invention to provide a decorative flange mask for covering a sink flange of a garbage disposal.

Another object of the present invention is to provide a decorative flange mask whose installation is easy and convenient.

Another object of the present invention is to provide a decorative flange mask which is easily removed and exchanged.

Yet another object of the present invention is to provide a decorative flange mask which includes an open cylindrical mask body and an annular mask lip connected to and extending radially outward from one end of the cylindrical mask body.

Still another object of the present invention is to provide a decorative flange mask which includes an open cylindrical mask body with an outer annular groove for receiving an inner annular ridge of an open cylindrical body portion of a disposer sink flange upon insertion of the open cylindrical mask body into the open cylindrical body portion.

Still another object of the present invention is to provide an improved garbage disposal assembly which includes a garbage disposal body unit, a sink flange, a mounting assembly for securing the garbage disposal body unit and the sink flange to the sink, and a flange mask for covering the sink flange.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
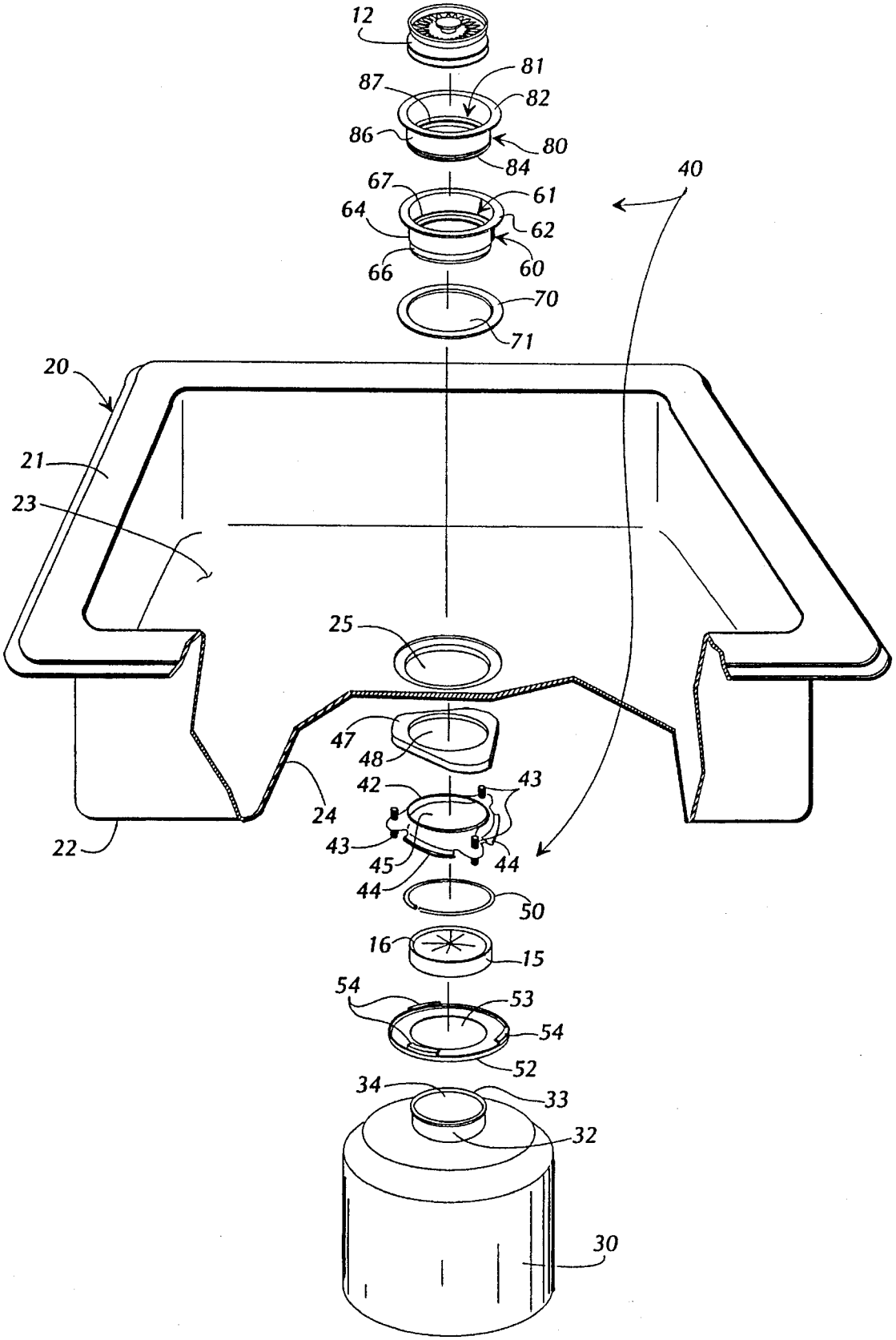
FIG. 1 is an exploded perspective view of a Garbage Disposal Assembly With a Decorative Sink Flange Mask in accordance with the preferred embodiment of the present invention shown with a cut-away view of a sink.

Referring now in greater detail to the drawings, in which like numerals represent like components throughout the several views, the preferred embodiment of a garbage disposal assembly 10, improved in accordance with the present invention, is shown in an exploded perspective view in FIG. 1 with a cut-away view of a sink 20. The sink 20 includes a sink top 21 and a sink bottom 22. The sink bottom 22 includes a sink bottom upper surface 23 and a sink bottom lower surface 24. Located at the center of the sink bottom 22 is a sink drain 25 which is defined by a cylindrical passageway. One example of an acceptable sink 20 is the well-known enamel-coated, stainless steel sink which is commonly available in a variety of colors. References to "sink-side" appearances of the garbage disposal assembly 10 refer to top views showing the sink bottom upper surface 23.

The garbage disposal assembly 10 consists of a disposal body unit 30, an attachment assembly 40, a flange mask 80, and a strainer-stopper 12. It should first be understood that examples of an acceptable disposal body unit 30 and attachment assembly 40 of the preferred embodiment of the present invention are available from In-Sink-Erator®, a division of Emerson Electric Co., of Racine, Wis. Accordingly, the operation and interrelationship of the elements of the disposal body unit 30 and attachment assembly 40 are considered well-known and understood by those reasonably skilled in the art.

The disposal body unit 30 includes a body collar 32 which defines a collar passage 34 through which garbage passes into the disposal body unit 30. A collar lip 33 encircles the distal end of the body collar 32. The attachment assembly 40 connects the disposal body unit 30 to the sink bottom 22. Included in the attachment assembly 40 is a body ring 52, a baffle cap 15, a snap ring 50, a mounting ring 42, a back-up ring 47, a flange gasket 70, and a sink flange 60.

The body ring 52 is seen having three body ring hooks 54 and defining a body ring passage 53 which is sized to pass around the collar lip 33 and down the body collar 32. A rubber baffle cap 15 with a baffle inset 16 is designed to snap onto the body collar 32 to secure the body ring 52 against the disposal body unit 30. The remaining elements of the attachment assembly 40, along with the flange mask 80, are seen assembled in the sink bottom 22 in the cross-sectional view of FIG. 2, which should also be referred to during the following description.

The sink flange 60 is seen defining a flange passage 61 and including a flange lip 62 and a flange body 64. Defined around the outer surface of the flange body 64 is an annular ring groove 66. A corresponding annular ring ridge 67 is seen on the inside of the flange body 64. The flange gasket 70 is seen defining a gasket passage 71 and being sized to pass around the flange body 64 of the sink flange 60. The back-up ring 47 and mounting ring 42 are seen defining a back-up ring passage 48 and a mounting ring passage 45, respectively, which are also sized to pass around the flange body 64 of the sink flange 60. The mounting ring 42 also includes three mounting screws 43 and three mounting ledges 44.

Figure 2:
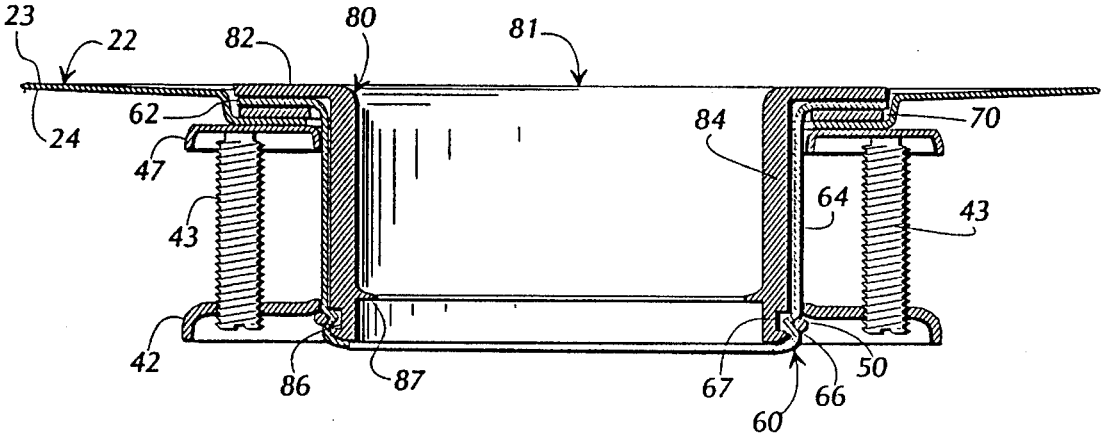
FIG. 2 is a cross-sectional view of portions of the garbage disposal assembly of FIG. 1 shown installed in a sink.
Figure 3:
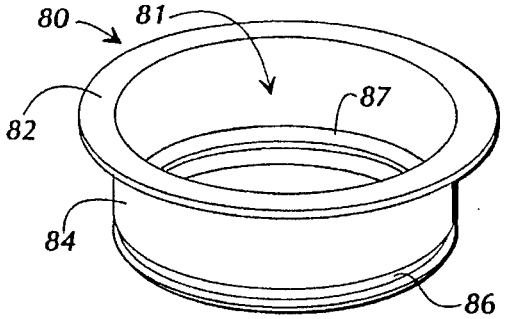
FIG. 3 is a perspective view of the flange mask of FIG. 1.
Figure 4:
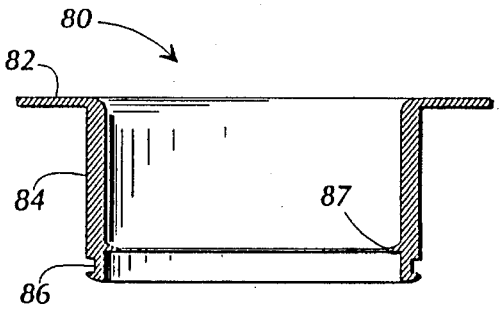
FIG. 4 is a cross-sectional view of the flange mask of FIG. 1.
Figure 5:
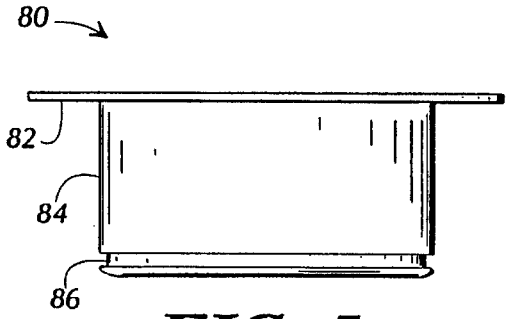
FIG. 5 is a front elevational view of the flange mask of FIG. 1.
Figure 6:
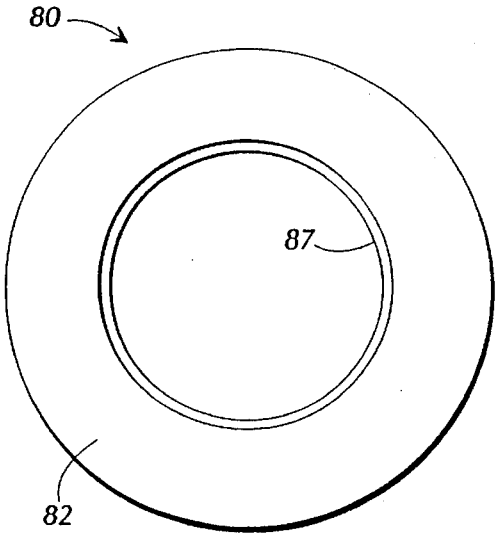
FIG. 6 is a top view of the flange mask of FIG. 1.
Figure 7:
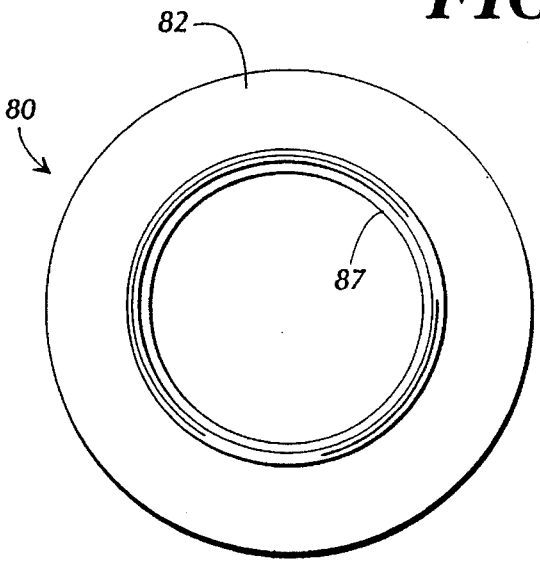
FIG. 7 is a bottom view of the flange mask of FIG. 1.

During assembly, the flange body 64 is inserted through the gasket passageway 71 of the flange gasket 70 and then inserted through the sink drain 25. At this point, the flange lip 62 rests on the flange gasket 70 which abuts the sink bottom upper surface 23. The back-up ring 47 is then passed around the flange body 64 to abut against the sink bottom lower surface 24. The mounting ring 42 is then passed around the flange body 64 until the mounting screws 42, loosened for assembly, Contact the back-up ring 47. The snap ring 50 is then attached around the ring groove 66 to prevent the mounting ring 42 from slipping off of the flange body 64. The mounting screws 43 are then tightened to secure the assembly to the sink 20, as is shown in FIG. 2. Referring to FIG. 1, the disposal body unit 30, along with the baffle cap 15 and-body ring 52, are then attached by rotating the body ring hooks 54 over the mounting ledges 44 so that the bottom of the flange body 64 is seated into the baffle inset 16.

The flange mask 80, which is also seen in several views in FIGS. 3–7, defines a mask passage 81 and includes a mask lip 82 and a mask body 84. An annular mask groove 86 is defined around the outside of the mask body 84, and an annular stopper ridge 87 is defined around the inside of the mask body 84. In the preferred embodiment, the flange mask 80 is constructed of colored plastic to match the color of the sink 20. During assembly, after a common sealant is applied to the underside of the mask lip 82, the mask body 84 is inserted downward into the flange passage 61. Insertion ceases when the mask lip 82 seals against flange lip 62 and the mask groove 86 engages the ring ridge 67 to lock the flange mask 80 into place. The strainer-stopper 12 is sized to fit into mask passage 81 and rest on the stopper ridge 87. In the preferred embodiment, the strainer-stopper 12 is of a common construction which enables a user to selectively stop the flow of water through the mask passage 81.

It should be understood that in alternate embodiments of the present invention, the mask groove 86 is alternately shaped to correspond to alternately shaped flange bodies 64 and/or alternately shaped annular ring ridges 67 of the sink flange 60. Furthermore, alternate attachment assemblies 40, including, without limitation, flange bodies with threaded outer surfaces, (some of which are already known in the art) are also contemplated within the scope of the present invention.

Also, other qualities of appearance of the sink flange 60, such as texture, are varied through the use of other flange masks 80 in accordance with other alternate embodiments. Furthermore, various draining properties of the sink 20 are selectively altered with other flange masks 80 in accordance with other alternate embodiments.

While the embodiments of the present invention which have been disclosed herein are the preferred forms, other embodiments of the apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative dimensions and relationships shown on the drawings are given as the preferred relative dimensions and relationships, but the scope of the invention is not to be limited thereby.

I claim:

1. Method of selectively varying the sink-side appearance of a garbage disposal, which garbage disposal includes at least a sink flange having an open cylindrical body portion and an annular lip portion connected to and extending radially outward from one end of the cylindrical body portion for being located above a sink bottom, said method comprising the steps of:

coaxially orienting above the sink flange installed in the sink bottom a flange mask including a cylindrical body portion and an annular lip portion connected to and extending radially outward from one end of the cylindrical body portion; and pushing the flange mask downward into the sink flange until the cylindrical body portion of the flange mask extends substantially down into the cylindrical body portion of the sink flange, the lip portion of the flange mask is adjacent the lip portion of the sink flange, and the flange mask is secured, through said pushing alone, within the sink flange.

2. Method of claim 1, wherein the step of pushing the flange mask into the sink flange includes creating securing interaction between the open cylindrical body portion of the sink flange and the cylindrical body portion of the flange mask.

3. Method of claim 1, wherein the cylindrical body portion of the flange mask defines an annular groove, and wherein the step of pushing the flange mask into the sink flange includes mounting the annular groove around an inner annular ridge defined by the open cylindrical body portion of the sink flange.

4. Method of claim 1, wherein the pushing step includes securely connecting the flange mask body portion to the sink flange body portion with an interconnecting member extending from one toward the other of the mask body portion and the flange body portion.

5. Method of claim 1, wherein the pushing step includes securely connecting the flange mask body portion to the sink flange body portion with an interconnecting member extending from the flange body portion toward the mask body portion.

6. Method of claim 1, wherein the cylindrical flange body portion includes a bottom end defining a bottom horizontal plane, and the annular flange lip portion includes an upper surface defining an upper horizontal plane, and wherein the pushing step further includes pushing the flange mask downward into the sink flange until the cylindrical mask body portion extends down into the flange body portion a distance equal to at least 30% of a vertical distance between the upper horizontal plane and the bottom horizontal plane.

7. Method of claim 1, wherein the cylindrical flange body portion includes a bottom end defining a bottom horizontal plane ,and the annular flange lip portion includes an upper surface defining an upper horizontal plane, and wherein the pushing step further includes pushing the flange mask downward into the sink flange until the cylindrical mask body portion extends down into the flange body portion a distance equal to at least 50% of a vertical distance between the upper horizontal plane and the bottom horizontal plane.

8. Method of claim 1, wherein the annular mask lip portion consists only of an annular planar member, wherein the annular flange lip portion of the sink flange includes a peripheral outer surface and a bottom surface, and wherein the peripheral outer surface and the bottom surface of the annular flange lip portion are completely absent contact with the flange mask after the pushing step.

9. The method of claim 1, wherein the cylindrical mask body portion includes a cylindrical outer surface, wherein the annular mask lip portion of the flange mask is planar, wherein the planar annular mask lip portion is the only portion of the flange mask located outside of the cylindrical outer surface of the cylindrical mask body portion, and wherein the only portion of the sink flange mask contacting the annular flange lip portion is the planar annular mask lip portion.

10. A sink flange assembly comprising:

a sink flange including, a cylindrical flange body portion, and an annular flange lip portion flaring outward from said flange body portion, wherein said annular flange lip includes an upper surface, a peripheral outer edge surface, and a bottom surface; and a sink flange mask contacting said sink flange including a cylindrical mask body portion extending substantially down into said flange body portion and contacting said flange body portion, and an annular mask lip portion flaring outward from said mask body portion, said lip portion contacting only said upper surface of said flange lip portion.

11. The assembly of claim 10, further comprising an interconnecting member extending between said mask body portion and said flange body portion.

12. The apparatus of claim 11, wherein said interconnecting member extends from one toward the other of said mask body portion and said flange body portion.

13. The apparatus of claim 12, wherein said interconnecting member extends from said flange body portion toward said mask body portion.

14. The apparatus of claim 13, wherein said interconnecting member extends from said flange body portion as an annular ridge, and wherein said mask body portion defines an annular groove complementary to said annular ridge.

15. The apparatus of claim 10, wherein said sink flange mask and said sink flange are substantially similar in three-dimensional shape.

16. The apparatus of claim 10, wherein said peripheral outer edge surface and said bottom surface of said annular flange lip portion are completely absent contact by any portion of said sink flange mask.

17. The apparatus of claim 10, wherein said annular mask lip portion consists only of an annular, planar member.

18. The apparatus of claim 10, wherein said cylindrical flange body portion includes a vertical cylindrical inner surface, wherein said flange mask body portion includes a vertical cylindrical outer surface, wherein said vertical cylindrical outer surface of said flange mask body portion contacts and extends substantially down along said vertical cylindrical inner surface of said cylindrical flange body portion.

19. The assembly of claim 10, wherein said cylindrical flange body portion includes a bottom end defining a bottom horizontal plane, and said annular flange lip portion upper surface defines an upper horizontal plane, and wherein said cylindrical mask body portion extends down into said flange body portion a distance equal to at least 30% of a vertical distance between said upper horizontal plane and said bottom horizontal plane.

20. The assembly of claim 10, wherein said cylindrical flange body portion includes a bottom end defining a bottom horizontal plane and said annular flange lip portion upper surface defines an upper horizontal plane, and wherein said cylindrical mask body portion extends down into said flange body portion a distance equal to at least 50% of a vertical distance between said upper horizontal plane and said bottom horizontal plane.

21. The assembly of claim 10, further comprising means for retaining said flange mask securely within said sink flange.

22. The assembly of claim 21, wherein said retaining means includes an annular retaining member extending between said flange mask body portion and said sink flange body portion.

23. The assembly of claim 22, wherein said annular retaining member extends from said sink flange body portion towards said mask body portion.

24. The assembly of claim 10, wherein said cylindrical mask body portion includes a cylindrical outer surface, wherein said annular mask lip portion of said flange mask is planar, and wherein said planar annular mask lip portion is the only portion of said sink flange mask located outside of said cylindrical outer surface of said cylindrical mask body portion.

25. The assembly of claim 24, wherein the only portion of said sink flange mask contacting said annular flange lip portion is said planar annular mask lip portion.

26. Method of masking a sink flange installed in a sink, said sink flange including a cylindrical flange body portion and an annular flange lip portion connected to and extending radially outward from a top end of the cylindrical flange body portion, said method comprising the steps of:

coaxially orienting above the sink flange installed in the sink a sink flange mask having a cylindrical mask body portion and an annular mask lip portion connected to and extending radially outward from a top end of the cylindrical mask body portion; and pushing the flange mask downward into the sink flange until the cylindrical body portion of the flange mask extends substantially down into the cylindrical body portion of the sink flange, the annular mask lip portion is located adjacent the annular flange lip portion, and the flange mask is completely secured, through said pushing alone, within the sink flange.

27. The method of claim 26, wherein the sink flange mask and the sink flange are substantially similar in three-dimensional shape.

28. The method of claim 26, wherein the pushing step includes masking the annular flange lip portion with the annular mask lip portion.

29. The method of claim 26, wherein the annular flange lip portion includes an upper surface, a peripheral outer edge surface, and a bottom surface, and wherein the pushing step includes contacting none of the bottom surface and the peripheral outer edge surface by the annular mask lip portion.

30. The method of claim 26, wherein the annular mask lip portion consists only of an annular planar member.

31. Method of claim 26, wherein the step of pushing the flange mask into the sink flange includes creating securing interaction between the open cylindrical body portion of the sink flange and the cylindrical body portion of the flange mask.

32. Method of claim 26, wherein the cylindrical body portion of the flange mask defines an annular groove, and wherein the step of pushing the flange mask into the sink flange includes mounting the annular groove around an inner annular ridge defined by the open cylindrical body portion of the sink flange.

33. Method of claim 26, wherein the pushing step further includes securely connecting the flange mask body portion to the sink flange body portion with an interconnecting member extending from one toward the other of the mask body portion and the flange body portion.

34. Method of claim 26, wherein the pushing step further includes securely connecting the flange mask body portion to the sink flange body portion with an interconnecting member extending from the flange body portion toward the mask body portion.

35. Method of claim 26, wherein the cylindrical flange body portion includes a bottom end defining a bottom horizontal plane, and the annular flange lip portion includes an upper surface defining an upper horizontal plane, and wherein the pushing step further includes pushing the flange mask downward into the sink flange until the cylindrical mask body portion extends down into the flange body portion a distance equal to at least 30% of a vertical distance between the upper horizontal plane and the bottom horizontal plane.

36. Method of claim 26, wherein the cylindrical flange body portion includes a bottom end defining a bottom horizontal plane ,and the annular flange lip portion includes an upper surface defining an upper horizontal plane, and wherein the pushing step further includes pushing the flange mask downward into the sink flange until the cylindrical mask body portion extends down into the flange body portion a distance equal to at least 50% of a vertical distance between the upper horizontal plane and the bottom horizontal plane.

37. Method of claim 26, wherein the annular mask lip portion consists only of an annular planar member, wherein the annular flange lip portion of the sink flange includes a peripheral outer edge surface and a bottom surface, and wherein the peripheral outer edge surface and the bottom surface of the annular flange lip portion are completely absent contact by the sink flange mask after the pushing step.

38. The method of claim 26, wherein the pushing step includes completely masking from view the annular flange lip portion and the cylindrical flange body portion with the sink flange mask.

39. The method of claim 26, wherein the cylindrical mask body portion includes a cylindrical outer surface, wherein the annular mask lip portion of the flange mask is planar, wherein the planar annular mask lip portion is the only portion of the flange mask located outside of the cylindrical outer surface of the cylindrical mask body portion, and wherein the only portion of the sink flange mask contacting the annular flange lip portion is the planar annular mask lip portion.

40. A sink flange assembly comprising:

a sink flange including, a vertical cylindrical flange body portion including a top end and a bottom end defining a bottom horizontal plane, and an annular flange lip portion flaring outward from said top end of said flange body portion, wherein said annular flange lip includes an upper surface defining an upper horizontal plane, a peripheral outer surface, and a bottom surface; and a sink flange mask contacting said sink flange and consisting only of a vertical cylindrical mask body portion extending substantially down into said flange body portion and contacting said flange body portion, and a planar mask lip portion extending radially outward from said cylindrical mask body portion.

41. The assembly of claim 40, wherein said cylindrical mask body portion extends down into said flange body portion a distance equal to at least 30% of the vertical distance between said upper horizontal plane and said bottom horizontal plane.

42. The assembly of claim 40, wherein said cylindrical mask body portion extends down into said flange body portion a distance equal to at least 50% of the vertical distance between said upper horizontal plane and said bottom horizontal plane.

43. The assembly of claim 40, further comprising an interconnecting member extending between said mask body portion and said flange body portion.

44. The assembly of claim 43, wherein said interconnecting member extends from one toward the other of said mask body portion and said flange body portion.

45. The assembly of claim 43, wherein said interconnecting member extends from said flange body portion toward said mask body portion.

46. The assembly of claim 45, wherein said interconnecting member extends from said flange body portion as an annular ridge, and wherein said mask body portion defines an annular groove complementary to said annular ridge.

47. The apparatus of claim 40, wherein said sink flange mask and said sink flange are substantially similar in three-dimensional shape.

48. The apparatus of claim 40, wherein said planar mask lip portion contacts said upper surface of said annular flange lip portion only.

* * * * *